United States Patent [19]

Staerzl

[11] Patent Number: 4,528,460

[45] Date of Patent: Jul. 9, 1985

[54] CATHODIC PROTECTION CONTROLLER

[75] Inventor: Richard E. Staerzl, Fond du Lac, Wis.

[73] Assignee: Brunswick Corporation, Skokie, Ill.

[21] Appl. No.: 452,581

[22] Filed: Dec. 23, 1982

[51] Int. Cl.[3] ..... H01B 7/28

[52] U.S. Cl. ..... 307/95; 204/196; 204/147

[58] Field of Search ..... 307/91, 95; 440/49, 440/113, 900; 204/147, 196; 323/285; 361/1

[56] References Cited

U.S. PATENT DOCUMENTS 4,160,171 7/1979 Merrick ..... 307/95

4,322,633 3/1982 Staerzl ..... 307/95

*Primary Examiner*—A. D. Pellinen
*Assistant Examiner*—T. DeBoer
*Attorney, Agent, or Firm*—O. T. Sessions

[57] ABSTRACT

A control system (17) for cathodically protecting an outboard drive unit (11) from corrosion includes an anode (12) and a reference electrode (13) mounted on the drive unit (11). Current supplied to the anode is controlled by a transistor (20), which in turn is controlled by an amplifier (25). The amplifier is biased to maintain a relatively constant potential on the drive unit (11) when operated in either fresh or salt water.

5 Claims, 2 Drawing Figures

CATHODIC PROTECTION CONTROLLER

TECHNICAL FIELD

This invention relates to cathodic protection systems and particularly to controllers for such systems.

BACKGROUND ART

Cathodic protection systems for supplying current to an anode to polarize a submersible metal unit such as a marine drive unit are well known. One such system is disclosed in U.S. Pat. No. 4,322,633 to the present inventor. In that system a control system controls the current supplied to the anode in response to the potential sensed by a reference electrode. Though that system has been highly effective, it requires the reference electrode to be mounted a substantial distance from the anode to provide an appropriate signal indicative of the potential of the protected unit, particularly when used in both fresh and salt water.

Another system, described in U.S. patent application Ser. No. 402,191, filed on July 26, 1982 by the present inventor, now U.S. Pat. No. 4,492,877, discloses an electrode apparatus for a cathodic protection system which uses a grounded shield mounted between the anode and the reference electrode to allow the anode and reference electrode to be mounted in close proximity to each other.

DISCLOSURE OF INVENTION

The present invention is particularly directed to a current supply system for connection to an anode, a reference electrode and a submersible metal unit to supply current to the anode to protect the submersible metal unit from corrosion. The current supply system includes a current controller connected in series with a power source between the submersible metal unit and the anode to control the electrical current supplied to the anode. An amplifier is connected between the reference electrode and the current controller to operate the current controller in response to the potential of the reference electrode. To compensate for the voltage drop between the anode and the reference electrode, a biasing circuit is connected between the amplifier and the anode. This arrangement acts to hold the potential at the surface of the protected metal unit relatively constant, regardless of the anode current.

Preferably the biasing circuit includes a constant voltage source to establish a minimum bias level supplied by the biasing circuit to the amplifier.

A salinity sensing circuit can be connected to the bias network to lower the bias signal provided to the amplifier when the system is operating in salt water, thereby compensating for the change in resistivity of the water in which the system is operating. The salinity sensing circuit can conveniently use a comparator to compare the anode current to the anode voltage to determine whether the system is operating in salt water or not.

In the preferred embodiment, a current limiting circuit is provided to protect the metal unit from damage resulting from excessive anode current.

The invention thus provides a current supply system for a cathodic protection system which is self-adaptive for use in either fresh or salt water and which allows the anode and reference electrode to be mounted relatively close together, as compared to other systems.

BEST MODE FOR CARRYING OUT THE INVENTION

Figure 1:
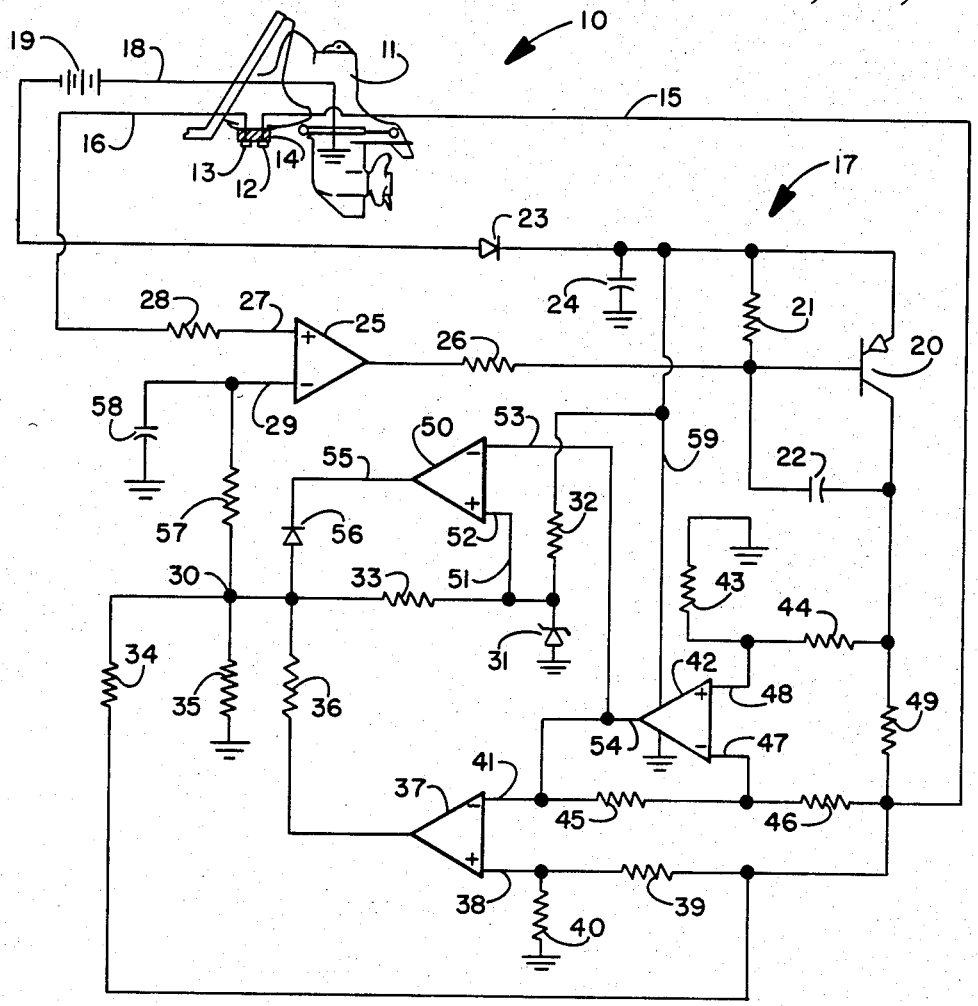
FIG. 1 is a schematic circuit diagram of a cathodic protection controller according to the invention.

Referring to the drawings, FIG. 1 shows a cathodic protection system 10 for protecting a marine drive unit 11, illustrated as a stern drive, from corrosion. The system 10 includes an anode 12 and a reference electrode 13 mounted on the protected drive unit 11, but electrically insulated from the drive unit by a suitable insulating layer 14. The anode 12 and reference electrode 13 are connected by leads 15 and 16, respectfully, to a current control system 17 which, in turn is connected by a lead 18 to the positive terminal of a suitable source of direct current, illustrated as a battery 19. The negative terminal of the battery 19 is connected to the system ground, in this case the metal drive unit 11. The control system 17 operates to maintain the surface of the drive unit 11 at a desired potential by supplying current to the anode 12 in response to a signal from the reference electrode 13, thereby impressing voltage across the load presented by the junction of the surface of the drive unit 11 and the water in which the drive unit 11 is immersed.

The current control system 17 includes a current supply circuit for supplying electrical current to the anode 12. The current supply circuit includes a PNP transistor 20 having its emitter connected to the positive terminal of the battery 19 and its collector connected to the anode 12. The transistor 20 is used as a class A amplifier to act as a current controller to control the current supplied to the anode 12. A bias resistor 21 is connected between the emitter and base of the transistor 20 to prevent current leakage from the emitter to the base and a frequency compensation capacitor 22 is connected between the collector and the base to prevent unwanted oscillations. A diode 23, connected between the emitter of the transistor 20 and the battery 19, protects the circuit from reverse voltage which could be imposed on the circuit if the battery 19 was connected incorrectly. Finally, a capacitor 24 is connected between the transistor's emitter and ground to act as an RF noise filter.

The operation of the current controlling transistor 20 is controlled by the output of an operational amplifier 25 having its output connected to the base of the transistor 20 through a current limiting resistor 26. The operational amplifier 25 is connected as a non-inverting amplifier, with its non-inverting input 27 connected to the reference electrode 13 through a protecteive resistor 27. The inverting input 29 of the main amplifier 25 is connected to a node 30 of a biasing circuit to provide a suitable bias for the amplifier 25. The main amplifier 25 thus acts, when the input from the reference electrode 13 is less than that from the biasing circuit, to draw current from the base of the transistor 20 and bias the transistor 20 to conduct, thereby supplying current to the anode 12.

A constant voltage source is provided to the biasing circuit by a zener diode 31 connected between the battery 19 and ground. A current limiting resistor 32 is placed between the zener diode 31 and the battery 19 to protect the zener diode 31 from excessive currents. The cathode of the zener diode 31 is connected to the node 30 in the biasing circuit through a dropping resistor 33. The dropping resistor 33 is sized to produce the desired potential at the node 30, preferably about 0.92 volts. The node 30 thus acts as a constant voltage reference. The biasing circuit also includes a pair of resistors 34 and 35 connected between the anode 12 and system ground to act as a voltage divider. The resistors 33, 34, 35 and 36 are sized to simulate the voltage drop in water between the load and the reference electrode 13. The potential of the node is thus held at 0.92 volts or higher by the combined effects of the zener diode 31 and the resistors 33, 34, 35 and 36 connected to the anode 12, thereby providing a bias input to the inverting terminal 29 of the non-inverting amplifier 25 which compensates for the voltage drop between the load and reference electrode 13 which results from the resistivity of the water.

A salinity detecting circuit is also provided to compensate for the sharp change in resistivity between fresh and salt water. This circuit includes an operational amplifier 37 which functions as a comparator, supplying an electrically positive output to the node 30 of the biasing circuit when the system is operating in fresh water and a negative output when operating in salt water. The non-inverting input 38 of the comparator is provided with a signal representative of the anode voltage by a voltage divider made up of resistors 39 and 40 connected between the anode 12 and ground to reduce the anode voltage to a level compatible with the operation of the comparator 37. The inverting input 41 of the comparator 37 is supplied with a signal representative of the current supplied to the anode 12. By comparing the anode current to the anode voltage, the system will differentiate between operation in salt water and operation in fresh water because of the difference in resistivity of the water.

The anode current signal is supplied to the comparator 37 by the output of an operational amplifier 42 connected by resistors 43, 44, 45 and 46 to function as a differential amplifier. The differential amplifier 42 has its inverting and non-inverting inputs 47 and 48 connected through resistors 46 and 44 to opposite sides of a shunt resistor 49 connected between the current controlling transistor 20 and the system anode 12. Resistors 45 and 46 provide a feedback network and are sized to set the gain provided by the differential amplifier 42. The differential amplifier 42 thus provides a signal to the inverting input 41 of the comparator 37 which is representative of the voltage drop across the shunt resistor 49, thereby representing the anode current.

Because excessive anode current can cause damage to portions of the protected metal unit surrounding the anode 12, an anode current limiting circuit is provided. The anode current limiting circuit includes an operational amplifier 50 connected to function as an inverting amplifier with an offset. The offset is provided by a connection 51 between the non-inverting input 52 of the inverting amplifier 50 and the cathode of the zener diode 31, thus fixing the potential of the non-inverting input 52. The inverting input 53 of the amplifer is connected to the output 54 of the current sensing differential amplifier 42 to receive a signal representing the anode current. So connected, the inverting amplifier 50 produces a positive output when the potential at the inverting input 53 is less than the potential fixed at the non-inverting input 52 and produces a negative output when the potential at the inverting input 53 is greater than that fixed at the non-inverting input 52. The output 55 of the inverting amplifier 50 is connected through a diode 56 to the node 30 of the biasing circuit. The diode 56 acts to block the flow of current to the node 30 when the output 55 of the inverting amplifier 50 is positive. When the output 55 of the inverting amplifier 50 is negative, indicating the anode current has exceeded a predetermined level, current will flow from the node 30 to the output 55 of the inverting amplifier 50, thereby reducing the potential at the node 30 to reduce the biasing level of the main amplifier 25 and consequently reducing the system anode current to the desired level.

The node 30 of the biasing circuit is coupled to the inverting terminal 29 of the main amplifier 25 through a resistance-capacitance filter consisting of a resistor connected between the node 30 and the inverting terminal 29 and a capacitor 58 connected between the system ground and the inverting terminal 29. The resistor 57 and capacitor 58 are sized to give a time constant of about 0.5 seconds. The R-C filter thus prevents system oscillations which could otherwise result from the relatively slow response time of the system's load to changes in the anode current.

The four operational amplifiers used in the circuit are preferably formed as a single integrated circuit which is available from National Semiconductor, designated as an LM324 operational amplifier. The integrated circuit is connected by a circuit 59 to the positive terminal of the battery 19 and by another circuit to system ground to provide power for operating the amplifier.

OPERATION

In operation, the reference electrode 13 senses the potential near a submerged portion of the marine drive unit 11 near the anode 12 and supplies a signal to the main amplifier 25 which produces an output proportional to the difference between the signal from the reference electrode 13 and a bias signal supplied to the main amplifier 25 by the biasing circuit. The output signal from the main amplifier 25 is supplied to the base of the main transistor 20 to control the flow of current to the system anode 12.

If the potential of the reference electrode 13 decreases below the bias level supplied to the main amplifier 25, the amplifier responds by drawing current from the base of the main transistor 20 to render the transistor 20 conductive and supply current to the anode 12. The biasing circuit produces a bias signal which has a minimum predetermined value, preferably about 0.92 volts, at low anode currents and which increases as the anode current increases. The increasing bias signal compensates for the voltage drop through the water between the reference electrode 13 and the load, which increases with anode current and serves to hold the potential at the surface of the protected drive unit 11 essentially constant, regardless of the anode current.

Figure 2:
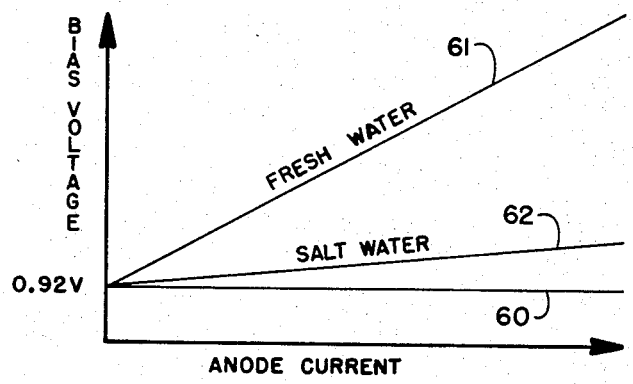
FIG. 2 is a graph useful in understanding the operation of the circuit of FIG. 1.

FIG. 2 is a hypothetical plot illustrating the operation of the system at various loading conditions requiring different anode currents to maintain an essentially constant potential at the load on the surface of the drive unit 11. The desired potential at the load is shown by a first line 60, and is constant at about 0.92 volts. A second sloping line 61 illustrates the desired bias voltage to be supplied to the main amplifier 25 as a function of anode current to maintain the desired constant potential at the load in fresh water. A third line 62 represents the desired bias voltage required for operation in salt water. To hold the potential of the surface relatively constant in either salt or fresh water, the salinity detecting circuit acts to shift the slope of the bias voltage supplied by the biasing circuit versus the anode current. As shown in the hypothetical curves of FIG. 2, this acts to shift the slope up for the reference electrode voltage versus anode current curve when the system is operating in fresh water and drop the slope of the curve down when operating in salt water. This is accomplished by directing current from the salinity detecting circuit to the biasing circuit when operating in fresh water and drawing current from the biasing circuit when in salt water. Thus the potential of the surface of the drive unit 11 is maintained essentially constant, about 0.92 volts, regardless of the water in which the system is operating and regardless of the anode current required.

I claim:

1. A current supply system for connection to an anode and a reference to supply current to said anode to protect a submersible metal unit from corrosion, said current supply system comprising:

(A) an electrical power source;

(B) a current controller to control the electrical current supplied to said anode, said current controller and said power source connected in series between said submersible metal unit and said anode;

(C) an amplifier connected between said reference electrode and said current controller to operate said current controller in response to the potential of said reference electrode;

(D) a bias network connected between said amplifier and said anode to provide a bias signal to said amplifier, said bias signal increasing as the current supplied to said anode increases to compensate for the voltage drop between said anode and said reference electrode; and (E) a voltage reference connected to said bias network to establish a minimum bias level supplied by said bias network to said amplifier.

2. The current supply system defined in claim 1 further comprising a salinity sensing circuit providing an output signal to said bias network to lower the bias signal provided to said amplifier when said system is operating in salt water.

3. The current supply system defined in claim 2 wherein said salinity sensing circuit includes an anode current sensor to provide a signal representative of the current supplied to said anode, an anode voltage sensing circuit to provide a signal representative of the potential of said anode, and a comparator connected to receive said signals from said anode current sensor and said anode voltage sensing circuit and to provide said output signal.

4. The current supply system defined in claim 3 further comprising a current limiting circuit connected between said bias network and said anode current sensor to reduce the bias signal supplied by said bias network when said anode current signal exceeds a predetermined level.

5. The current supply system defined in claim 4 further comprising a filter network connected between said amplifier and said bias network to allow time for said anode and said reference electrode to respond to changes in said current supplied to said anode.

* * * * *